US011716797B2

(12) United States Patent
Park et al.

(10) Patent No.: US 11,716,797 B2
(45) Date of Patent: Aug. 1, 2023

(54) DEVICE AND METHOD FOR CORRECTING INDIRECT LIGHTING COLOR IN RESPONSE TO CHANGES IN VEHICLE INTERIOR FINISHING MATERIAL

(71) Applicants: HYUNDAI MOTOR COMPANY, Seoul (KR); KIA CORPORATION, Seoul (KR)

(72) Inventors: Cheol Min Park, Seoul (KR); Dae Seon Lee, Seoul (KR); Jung Hyun Cho, Hwaseong-si (KR); Kwang Il Chang, Seongnam-si (KR); Nu Ri Jeon, Hwaseong-si (KR)

(73) Assignees: HYUNDAI MOTOR COMPANY, Seoul (KR); KIA CORPORATION, Seoul (KR)

( * ) Notice: Subject to any disclaimer, the term of this patent is extended or adjusted under 35 U.S.C. 154(b) by 0 days.

(21) Appl. No.: 17/845,646

(22) Filed: Jun. 21, 2022

(65) Prior Publication Data

US 2023/0041019 A1 Feb. 9, 2023

(30) Foreign Application Priority Data

Aug. 6, 2021 (KR) ..... 10-2021-0104017

(51) Int. Cl.
*H05B 45/20* (2020.01)

(52) U.S. Cl.
CPC ..... *H05B 45/20* (2020.01)

(58) Field of Classification Search
CPC . H05B 45/20; B60Q 3/60; B60Q 3/80; B60Q 3/82; B60Q 3/74; B60Q 3/54; G06T 15/50; G06T 15/64
See application file for complete search history.

(56) References Cited

U.S. PATENT DOCUMENTS

| | | | | |
|---|---|---|---|---|
| 7,993,042 | B2 | 8/2011 | Padilla | |
| 8,162,519 | B2 | 4/2012 | Salter et al. | |
| 8,786,418 | B2 | 7/2014 | Lucas | |
| 8,876,343 | B2 | 11/2014 | Murray et al. | |
| 8,982,126 | B1 * | 3/2015 | Mitev | G06T 17/20 345/426 |
| 2011/0128755 | A1 | 6/2011 | Ludwig et al. | |
| 2012/0212491 | A1 * | 8/2012 | Hager | G06T 15/50 345/426 |
| 2015/0023023 | A1 * | 1/2015 | Livesay | H01L 33/64 362/294 |

FOREIGN PATENT DOCUMENTS

WO 2017062691 A1 4/2017

* cited by examiner

*Primary Examiner* — Haissa Philogene
(74) *Attorney, Agent, or Firm* — Lempia Summerfield Katz LLC

(57) ABSTRACT

A device corrects an indirect lighting color in response to changes in a vehicle interior finishing material. An input unit of the device receives a finishing material color of a vehicle interior and a target indirect lighting color. A light source control map of the device includes light source control signals of indirect lighting based on finishing material colors and target indirect lighting colors. A controller of the device generates a light source control signal according to the finishing material color and the target indirect lighting color input to the input unit from the light source control map. The controller also corrects the color of a light source of control target indirect lighting by the generated light source control signal.

10 Claims, 4 Drawing Sheets

FIG. 4

| Target Indirect Lighting Color | | | | Reference Finishing Material (Black) Yuv Coordinates | | | Input Finishing Material (Brown) Yuv Coordinates | | | Color Difference according to Change in Finishing Material | Presence ofLight Source Control Map |
|---|---|---|---|---|---|---|---|---|---|---|---|
| | R Input (8 bit 0-255) | G Input (8 bit 0-255) | B Input (8 bit 0-255) | Y(cd/m2) Brightness | u Color Coordinates | v Color Coordinates | Y(cd/m2) Brightness | u Color Coordinates | v Color Coordinates | Δu v | Δu v ≥ 0.03 |
| #1 | 0 | 204 | 51 | 0.43 | 0.0704 | 0.4981 | 1.59 | 0.0691 | 0.5246 | 0.026 | Absent |
| #2 | 0 | 0 | 102 | 0.04 | 0.1478 | 0.1464 | 0.12 | 0.1546 | 0.1566 | 0.012 | Absent |
| #3 | 153 | 255 | 51 | 0.59 | 0.1282 | 0.5101 | 2.46 | 0.1678 | 0.5306 | 0.045 | Present |
| #4 | 255 | 255 | 153 | 0.68 | 0.1567 | 0.4467 | 2.90 | 0.2014 | 0.4851 | 0.059 | Present |
| #5 | 153 | 51 | 204 | 0.30 | 0.1937 | 0.3179 | 1.35 | 0.2355 | 0.3871 | 0.081 | Present |
| #6 | 255 | 0 | 204 | 0.23 | 0.2636 | 0.2734 | 1.20 | 0.3344 | 0.3643 | 0.115 | Present |
| #7 | 255 | 51 | 51 | 0.31 | 0.2471 | 0.4584 | 1.59 | 0.3127 | 0.4980 | 0.077 | Present |
| #8 | 255 | 0 | 51 | 0.18 | 0.3473 | 0.3935 | 1.07 | 0.4106 | 0.4648 | 0.095 | Present |
| #9 | 255 | 51 | 0 | 0.29 | 0.2815 | 0.5531 | 1.54 | 0.3365 | 0.5460 | 0.055 | Present |
| #10 | 255 | 0 | 0 | 0.16 | 0.4558 | 0.5264 | 1.02 | 0.4675 | 0.5294 | 0.012 | Absent |

DEVICE AND METHOD FOR CORRECTING INDIRECT LIGHTING COLOR IN RESPONSE TO CHANGES IN VEHICLE INTERIOR FINISHING MATERIAL

CROSS REFERENCE TO RELATED APPLICATION

The present application claims priority to Korean Patent Application No. 10-2021-0104017 filed on Aug. 6, 2021, the entire contents of which are incorporated herein for all purposes by this reference.

BACKGROUND

Field of the Disclosure

The present disclosure relates to a technology for correcting the color of indirect lighting within the cab of a vehicle.

Description of the Related Art

Various types of indirect lighting are used in vehicles in order to, for example, improve visibility and provide a luxurious feel.

In other words, indirect lighting may be realized on door trims, the center fascia, the dashboard, the roof, footsteps, and the like of a vehicle. The indirect lighting allows a user to easily find and operate a device that the user is required to operate even in the dark interior of the cab. to the indirect lighting may also provide a smooth and luxurious indoor atmosphere.

Recently, in a number of cases, indirect lighting may be configured such that a user may select a desirable color for the indirect lighting. Even when a light source, such as a light-emitting diode (LED) lamp, is controlled to generate light having the same color, a color that an occupant actually experiences may be significantly changed by, for example, the texture or color of an interior finishing material from which light emitted by the light source is reflected due to the characteristic of the indirect lighting. Thus, a case in which the intended color of the indirect lighting cannot be realized may occur.

The foregoing is intended merely to aid in understanding the background of the present disclosure. The foregoing is not intended to mean that the present disclosure falls within the purview of the related art that is already known to those having ordinary skill in the art.

SUMMARY

Accordingly, the present disclosure has been made by keeping in mind the above problems present in the related art. The present disclosure is intended to propose a device and a method for correcting an indirect lighting color in response to changes in a vehicle interior finishing material. The device and the method are configured to substantially realize indirect lighting having a color intended by a user by adjusting the color of a light source in consideration of the color of the vehicle interior finishing material.

According to one aspect, a device for correcting an indirect lighting color in response to changes in a vehicle interior finishing material is provided. The device includes an input unit configured to receive a finishing material color of a vehicle interior and a target indirect lighting color. The device also includes a light source control map including light source control signals of indirect lighting based on finishing material colors and target indirect lighting colors. The device also includes a controller configured to generate a light source control signal according to the finishing material color and the target indirect lighting color input to the input unit from the light source control map. The controller is also configured to correct the color of a light source of control target indirect lighting by the generated light source control signal.

The input unit may be configured such that the finishing material color of the vehicle interior is input by selecting one from predetermined color groups.

The color groups may include at least two of a brown group, a blue group, a green group, a red group, a beige group, and a black group.

When a predetermined reference finishing material color is different from the input finishing material color input to the input unit, the light source control map may include the light source control signals. Each of the light source control signals may control the color of indirect lighting reflected from a finishing material having the input finishing material color to be the same as the target indirect lighting color reflected from a finishing material having the reference finishing material color.

The light source of the control target indirect lighting may include red, green, blue (RGB) LEDs, and the light source control signals include RGB signals driving the RGB LEDs.

According to another aspect, a method of correcting the color of indirect lighting in response to changes in a vehicle interior finishing material is provided. The method includes receiving a finishing material color of a portion on which control target indirect lighting is located in a vehicle. The method also includes receiving a target indirect lighting color intended to be realized by the control target indirect lighting. The method also includes, when the input finishing material color is not a predetermined reference finishing material color, generating a light source control signal corresponding to a corrected light source color from a light source control map including light source control signals of indirect lighting based on finishing material colors and target indirect lighting colors. The method also includes correcting a light source color of the control target indirect lighting by the generated light source control signal.

The input finishing material color may be input by selecting one of color groups including at least two of a brown group, a blue group, a green group, a red group, a beige group, and a black group.

The difference between the target indirect lighting color reflected from a finishing material having the reference finishing material color and the target indirect lighting color reflected from a finishing material having the input finishing material color input to the input unit may be determined. In a light source control map, in a case in which this difference is equal to or greater than a predetermined reference difference value, each of the light source control signals of the light source control map may control the color of indirect lighting reflected from the finishing material having the input finishing material color to be the same as the target indirect lighting color reflected from a finishing material having the reference finishing material color.

In the target indirect lighting color reflected from the finishing material having the reference finishing material color, when the finishing material having the reference finishing material color expressed with L*a*b* color is irradiated with the target indirect lighting color expressed with RGB color, the indirect lighting color reflected from the finishing material having the reference finishing material color may be expressed with a color encoding system, such as the YUV color space, i.e., YUV color.

In the target indirect lighting color reflected from the finishing material having the input finishing material color input to the input unit, when the finishing material having the input finishing material color expressed with L*a*b* color is irradiated with the target indirect lighting color expressed with RGB color, the indirect lighting color reflected from the finishing material having the input finishing material color may be expressed with YUV color.

Thus, the difference between the target indirect lighting color expressed with the YUV color, reflected from the finishing material having the reference finishing material color, and the target indirect lighting color expressed with the YUV color, reflected from the finishing material having the input finishing material color input to the input unit may be obtained as Δuv.

When the target indirect lighting color reflected from the finishing material having the reference finishing material color is indicated with $Y_1u_1v_1$ and the target indirect lighting color reflected from the finishing material having the input finishing material color input to the input unit is indicated with $Y_2u_2v_2$, the Auv may be obtained from the following equation:

$$\Delta uv=\sqrt{(u_1-u_2)^2+(v_1-v_2)^2}$$

The controller may store color coordinates of correction values of a light source matched according to finishing material colors according to indirect lighting colors realizable in the vehicle.

The light source control signals may include RGB signals driving RGB LEDs serving as a light source of the control target indirect lighting.

The present disclosure can substantially realize indirect lighting having a color intended by a user by adjusting the color of a light source realizing indirect lighting in consideration of the color of the vehicle interior finishing material.

In particular, even when the color of an interior finishing material is changed due to tuning or repair, an intended indirect lighting color can be accurately realized. Thus, the usability of a vehicle consistent with the intention of a user may be provided.

In addition, it is possible to construct the light source control map in a suitable size, thereby accurately realizing an intended indirect lighting color at relatively low cost.

It should be appreciated by those having ordinary skill in the art that the effects that can be achieved with the present disclosure are not limited to those described above and other advantages of the present disclosure should be clearly understood from the following detailed description.

BRIEF DESCRIPTION OF THE DRAWINGS

The above and other objects, features, and advantages of the present disclosure should be more clearly understood from the following detailed description when taken in conjunction with the accompanying drawings, in which:

FIG. 4 is a graph illustrating an example of selecting a data group included in the light source control map by the method illustrated in FIG. 3 when the reference finishing material color is black and 10 target indirect lighting colors are intended to be realized for a brown finishing material.

DETAILED DESCRIPTION

Figure 1:
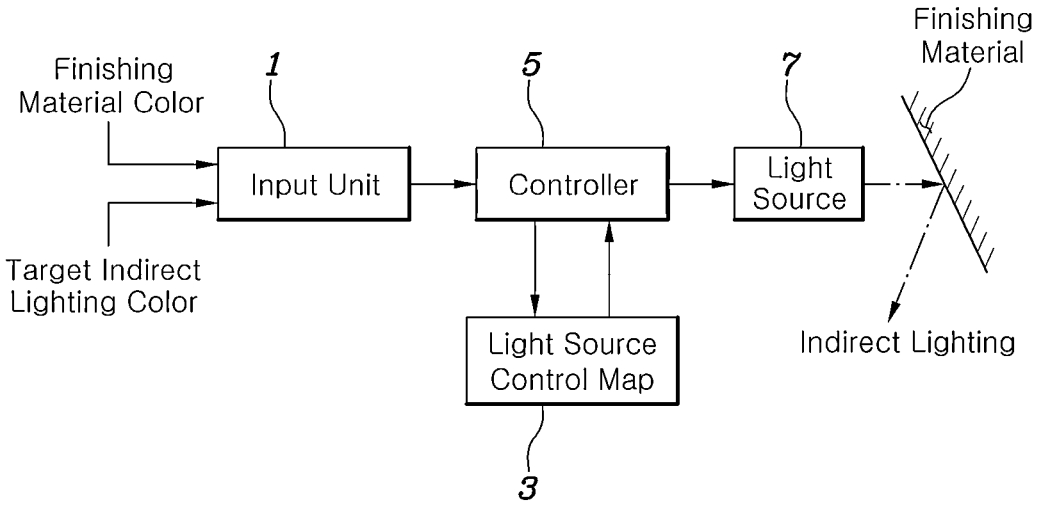
FIG. 1 is a block diagram illustrating an embodiment of a device for correcting an indirect lighting color in response to changes in a vehicle interior finishing material of the present disclosure.

Specific structural and functional descriptions of the embodiments of the present disclosure are illustrative only for the purpose of describing the embodiments according to the present disclosure. The embodiments according to the present disclosure may be implemented in various forms and should not be construed as being limited to embodiments described in this disclosure or application.

The embodiments according to the present disclosure may be variously modified and may have various forms, so that specific embodiments may be illustrated in the drawings and be described in detail in this disclosure or application. It should be understood, however, that it is not intended to limit the embodiments according to the concept of the present disclosure to specific disclosure forms. The present disclosure includes all modifications, equivalents, and alternatives falling within the spirit and scope of the present disclosure.

The terms first, second, and the like may be used to describe various components, but the components should not be limited by these terms. These terms may be used only for the purpose of distinguishing one component from another component. For example, a first component may be referred to as a second component, and similarly, the second component may also be referred to as the first component without departing from the scope of the present disclosure.

When a component is referred to as being "connected," or "coupled" to another component, it may be directly connected or coupled to another component, but it should be understood that another component may exist between the component and another component. On the contrary, when a component is referred to as being "directly connected" or "directly coupled" to another, it should be understood that another component may not be present between the component and another component. Other expressions describing the relationship between components, for example, "between" and "immediately between," or "adjacent to" and "directly adjacent to" should also be construed as described above.

The terms used herein are for the purpose of describing only specific embodiments and are not intended to limit the present disclosure. Unless the context clearly dictates otherwise, the singular form includes the plural form. In this disclosure, it should be construed that the terms "comprising," "having," or the like are used to specify that a feature, a number, a step, an operation, a component, an element, or a combination thereof described herein exists. These terms do not preclude the presence or addition of one or more other features, numbers, steps, operations, components, elements, or combinations thereof.

Unless defined otherwise, all terms including technical or scientific terms used herein have the same meaning as commonly understood by those having ordinary skill in the art to which the present disclosure pertains. General terms that are defined in a dictionary shall be construed to have meanings that are consistent in the context of the relevant art. Such terms should not be interpreted as having an idealistic or excessively formalistic meaning unless clearly defined in this disclosure.

Hereinafter, the inventive concept is described in detail by describing embodiments of the present disclosure with reference to the accompanying drawings. Throughout the drawings, the same reference numerals refer to the same or like parts. When a component, device, element, or the like of the present disclosure is described as having a purpose or performing an operation, function, or the like, the component, device, or element should be considered herein as being "configured to" meet that purpose or to perform that operation or function.

Referring to FIG. 1, a device for correcting an indirect lighting color in response to changes in a vehicle interior finishing material according to the present disclosure is shown. The device includes an input unit 1 configured to receive a finishing material color of a vehicle interior and an intended target indirect lighting color. The device also includes a light source control map 3 comprising light source control signals of indirect lighting based on finishing material colors and target indirect lighting colors. The device also includes a controller 5 generating a light source control signal according to the finishing material color and the target indirect lighting color input to the input unit 1 from the light source control map 3. The controller 5 also corrects the color of a light source 7 of control target indirect lighting (i.e., indirect lighting supposed to be controlled) by the generated light source control signal.

In other words, according to the present disclosure, a user, a vehicle manufacturing worker, a mechanic, or the like inputs a vehicle interior finishing material color and a target indirect lighting color to the input unit 1. When the color of a finishing material exposed to corresponding indirect lighting within the cab of a vehicle is the same as the input finishing material color, the controller 5 may generate a light source control signal for realizing the intended target indirect lighting color from the light source control map 3 and drive the light source 7 of the corresponding indirect lighting. In this manner, even when the color of the finishing material is changed, the target indirect lighting color may be properly realized.

During fabrication of a vehicle, a worker may input the interior finishing material color and the target indirect lighting color of the vehicle to the input unit 1. When the color of the finishing material of the vehicle is changed due to repair of the vehicle, a mechanic may input the changed color of the finishing material to the input unit 1.

In addition, a user of the vehicle may be basically allowed to input the target indirect lighting color to the input unit 1 and, only if necessary, to input the finishing material color.

For reference, the indirect lighting may be provided in a plurality of portions within the cabin of the vehicle and may be configured such that different finishing material colors or different target indirect lighting colors are selected. However, herein, it may be assumed that the finishing materials of the vehicle interior basically have a single color in order to avoid the complexity of explanation.

In addition, the expression "corresponding indirect lighting" means indirect lighting that the user intends to control in a case in which indirect lighting is provided in a plurality of portions in the vehicle.

The input unit 1 may be configured such that the finishing material color of the vehicle interior is input by selecting one from predetermined color groups.

In other words, it may be impossible to individually select all colors, since types of colors are substantially infinite. In a number of cases, it is substantially difficult to recognize the color difference. Thus, in consideration of the realization and the convenience of use of the device of the present disclosure, similar colors may be categorized as a color group, and the finishing material color may be input by selecting one of color groups.

For example, the color groups may be divided into a brown group, a blue group, a green group, a red group, a beige group, a black group, and the like.

The difference between the target indirect lighting color reflected from a finishing material having a predetermined reference finishing material color and the target indirect lighting color reflected from a finishing material having the input finishing material color input to the input unit 1 may be determined. In the light source control map, in a case in which this difference is equal to or greater than a predetermined reference difference value, each of the light source control signals of the light source control map 3 may control the color of indirect lighting reflected from the finishing material having the input finishing material color to be the same as the target indirect lighting color reflected from a finishing material having the reference finishing material color.

Here, the reference finishing material color may be selected to be black or gray.

In addition, the reference difference value is described below.

The light source of the control target indirect lighting may be implemented as red, green, and blue (RGB) light-emitting diodes (LEDs), and the light source control signals may be RGB signals driving the RGB LEDs.

Figure 2:
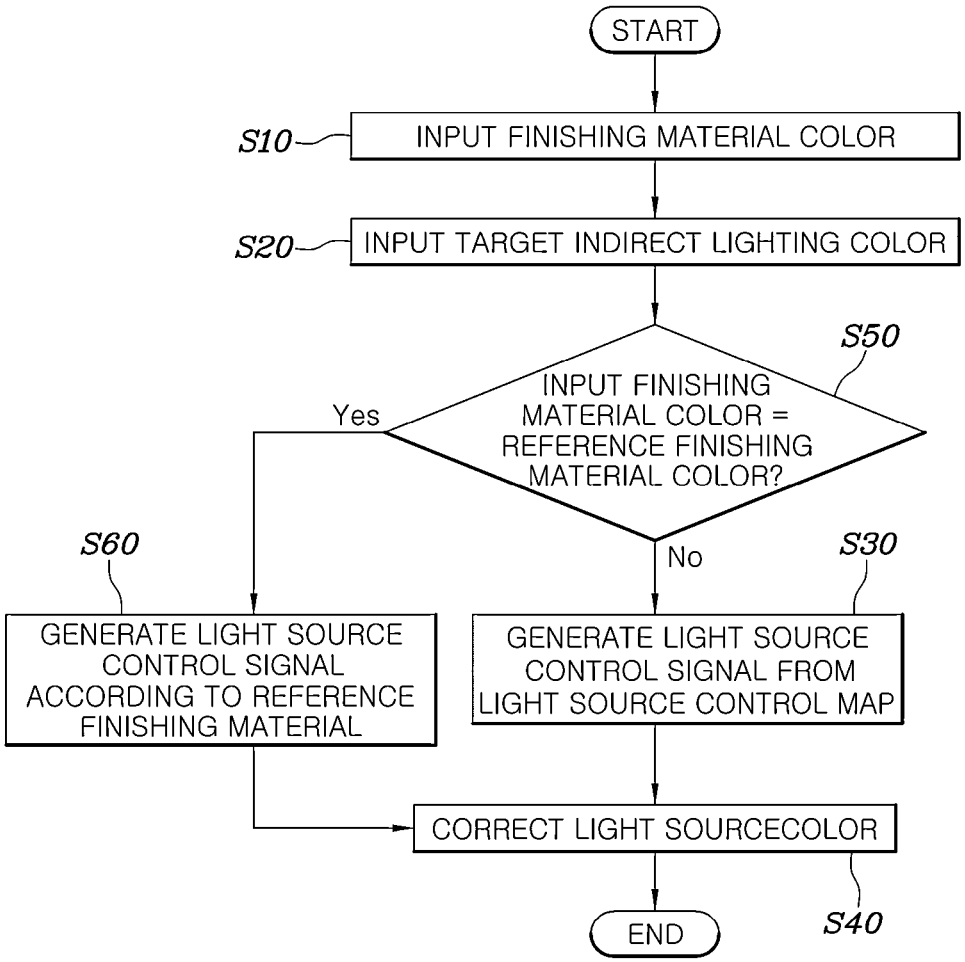
FIG. 2 is a flowchart illustrating an embodiment of a method of correcting an indirect lighting color in response to changes in a vehicle interior finishing material of the present disclosure.

FIG. 2 is a flowchart illustrating an embodiment of a method of correcting an indirect lighting color in response to changes in a vehicle interior finishing material of the present disclosure. The method includes step S10 of receiving a finishing material color of a portion on which control target indirect lighting is located in a vehicle. The method also includes step S20 of receiving a target indirect lighting color intended to be realized by the control target indirect lighting. The method also includes step S30 of generating a light source control signal corresponding to a corrected light source color from the light source control map 3 comprising light source control signals of indirect lighting based on finishing material colors and target indirect lighting colors when the input finishing material color is not a predetermined reference finishing material color (No in step S50). The method also includes step S40 of correcting a light source color of the control target indirect lighting by the generated light source control signal.

Here, although the step S10 of receiving the finishing material color is essential during fabrication or repair of the vehicle, the step S10 may be selectively performed when the vehicle is used by a user.

The finishing material color input as above may be input by selecting one of color groups including at least two of a brown group, a blue group, a green group, a red group, a beige group, a black group, and the like.

The reference finishing material color may be selected to be black or gray as described above. When the input finishing material color is the reference finishing material color (Yes in step S50), a light source control signal according to the reference finishing material color may be generated, and the light source of the indirect lighting may be controlled by the generated signal (step S60).

Here, the light source control signal according to the reference finishing material color may be substantially the same as an RGB signal indicating the target indirect lighting color.

This is because the color of indirect lighting formed by being reflected from the finishing material having the reference finishing material color, such as black or gray, is realized with substantially no change from the color of the light source.

For reference, the step S20 of receiving the target indirect lighting color in FIG. 2 is based on the assumption that the target indirect lighting color is input together with the finishing material color being input as illustrated in FIG. 2. In another case, i.e., in a case in which a previously-input target indirect lighting color is present, the previous target indirect lighting color may be used and the step S20 may be omitted.

The difference between the target indirect lighting color reflected from a finishing material having the reference finishing material color and the target indirect lighting color reflected from a finishing material having the input finishing material color input to the input unit 1 may be determined. In the light source control map 3, in a case in which this difference is equal to or greater than a predetermined reference difference value, each of the light source control signals of the light source control map 3 may control the color of indirect lighting reflected from the finishing material having the input finishing material color to be the same as the target indirect lighting color reflected from a finishing material having the reference finishing material color.

For example, in the target indirect lighting color reflected from the finishing material having the reference finishing material color, when the finishing material having the reference finishing material color expressed with L*a*b* color is irradiated with the target indirect lighting color expressed with RGB color, the indirect lighting color reflected from the finishing material having the reference finishing material color is expressed with a color encoding system such as the YUV color space, i.e., YUV color.

In addition, in the target indirect lighting color reflected from the finishing material having the input finishing material color input to the input unit 1, when the finishing material having the input finishing material color expressed with L*a*b* color is irradiated with the target indirect lighting color expressed with RGB color, the indirect lighting color reflected from the finishing material having the input finishing material color is expressed with YUV color.

Here, it is reasonable that the input finishing material color be interpreted to indicate a finishing material color expected to be input to the input unit 1 in a process of substantially constructing the light source control map 3 and a finishing material color actually input to the input unit 1 when the color of actual indirect lighting is corrected using the light source control map 3.

The difference between the target indirect lighting color expressed with the YUV color, reflected from the finishing material having the reference finishing material color, and the target indirect lighting color expressed with the YUV color, reflected from the finishing material having the input finishing material color input to the input unit 1 is obtained as Auv.

The target indirect lighting color reflected from the finishing material having the reference finishing material color is indicated with $Y_1u_1v_1$. The target indirect lighting color reflected from the finishing material having the input finishing material color input to the input unit 1 is indicated with $Y_2u_2v_2$.

The Auv may then be obtained from the following equation:

$$\Delta uv=\sqrt{(u_1-u_2)^2+(v_1-v_2)^2}$$

Figure 3:
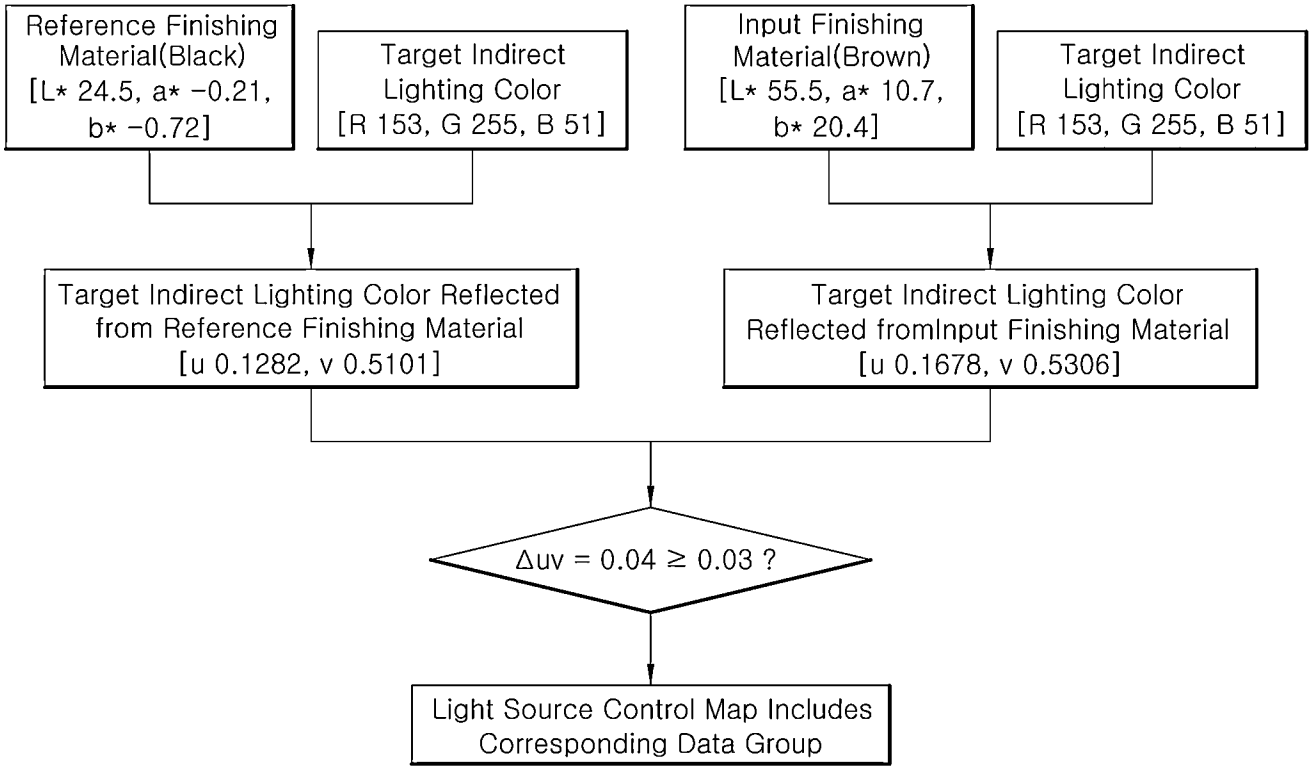
FIG. 3 is a diagram illustrating a method of selecting a data group included in a light source control map according to the color difference.

In other words, as illustrated in FIG. 3, in a case in which the reference finishing material color selected to be black is expressed with International Commission on Illumination (CIE) 1976 L*a*b* color space, such as L* 24.5, a* −0.21, and b* −0.72, and the target indirect lighting color is selected to be R 153, G 255, and B 51, when the finishing material having the reference finishing material color is irradiated with the target indirect lighting color, an indirect lighting color reflected from the finishing material is expressed with u 0.1282 and v 0.5101.

In addition, when the input finishing material color input to the input unit 1 is brown expressed with L* 55.5, a* 10.7, and b* 20.4, a reflected indirect lighting color obtained by irradiating a brown finishing material with the target indirect lighting color expressed with the same R 153, G 255, and B 51 as above may be expressed with u 0.1678 and v 0.5306.

In this case, the difference between the target indirect lighting color expressed with YUV color, reflected from the finishing material having the reference finishing material color, and the target indirect lighting color expressed with YUV color, reflected from the finishing material having the input finishing material color input to the input unit 1, may be obtained from the following equation:

$$\Delta uv=\sqrt{(0.1282-0.1678)^2+(0.5101-0.5306)^2}=0.04$$

For reference, Y in YUV indicates brightness and is not necessary for obtaining the color difference.

Here, in a case in which the reference difference value is determined to be, for example, 0.03, the color difference Auv is equal to or greater than the reference difference value, and thus, the finishing material color is brown. In a case in which the target indirect lighting color is R 153, G 255, and B 51, the light source control map 3 has a light source control signal causing an indirect lighting color reflected from the brown finishing material to be the same as the target indirect lighting color reflected from the finishing material having the reference finishing material color.

The reference difference value is a reference for selecting a data group (e.g., the finishing material color, the target indirect lighting color, and the light source control signal) to be included in the light source control map 3 as described above. When the reference difference value is excessively small, a data group may be provided for a color difference that is substantially difficult to visually distinguish. When the reference difference value is excessively large, no data group may be provided for a significant color difference that is visually distinguishable. In this manner, it is difficult to substantially realize the color of indirect lighting with an actually intended color. Accordingly, the difference value may be set to a suitable level in accordance with the above-described purpose through a number of experiments and analyses.

FIG. 4 illustrates an example of selecting a data group included in the light source control map by the method illustrated in FIG. 3. Referring to FIG. 4, when the reference finishing material color is black and the finishing material color of the finishing material disposed in the vehicle, supposed to be input by the user or the like, is brown, colors obtained by reflecting 10 target indirect lighting colors from the finishing material having the reference finishing material color and the finishing material having the input finishing material color are expressed with YUV, respectively, Auv is obtained for each of the 10 target indirect lighting colors, and whether or not Auv is included in the light source control map 3 is determined. Excepting for Nos. 1, 2, and 10, a data group for each of remaining Nos. 3-9 is provided in the light source control map 3.

The light source control signal in each of the data groups of the light source control map 3, i.e., the finishing material color, the target indirect lighting colors, and the light source control signal, may be obtained through a number of experiments and analyses so that the indirect lighting color reflected from the finishing material having the corresponding input finishing material color is the same as the target indirect lighting color reflected from the finishing material having the reference finishing material color.

Here, the light source control signal may be the RGB signal driving the RGB LEDs serving as the light source of the control target indirect lighting.

Although specific embodiments of the present disclosure have been described and illustrated, those having ordinary skill in the art should appreciate that various alternations and modifications are possible without departing from the technical spirit of the present disclosure as disclosed in the appended claims.

What is claimed is:

1. A device for correcting an indirect lighting color in response to changes in a vehicle interior finishing material, the device comprising:

an input unit configured to receive a finishing material color of a vehicle interior and a target indirect lighting color;

a light source control map comprising light source control signals of indirect lighting based on finishing material colors and target indirect lighting colors; and a controller configured to generate a light source control signal according to the finishing material color and the target indirect lighting color input to the input unit from the light source control map and configured to correct the color of a light source of control target indirect lighting by the generated light source control signal.

2. The device of claim 1, wherein the input unit is configured such that the finishing material color of the vehicle interior is input by selecting one from predetermined color groups.

3. The device of claim 2, wherein the color groups comprise at least two of a brown group, a blue group, a green group, a red group, a beige group, and a black group.

4. The device of claim 1, wherein, when a predetermined reference finishing material color is different from the input finishing material color input to the input unit, the light source control map comprises the light source control signals each of which controls the color of indirect lighting reflected from a finishing material having the input finishing material color to be the same as the target indirect lighting color reflected from a finishing material having the reference finishing material color.

5. The device of claim 1, wherein the light source of the control target indirect lighting comprises red, green, blue (RGB) light emitting diodes (LEDs), and the light source control signals comprise RGB signals driving the RGB LEDs.

6. A method of correcting the color of indirect lighting in response to changes in a vehicle interior finishing material, the method comprising:

receiving a finishing material color of a portion on which control target indirect lighting is located in a vehicle;

when the input finishing material color is not a predetermined reference finishing material color, generating a light source control signal corresponding to a corrected light source color from a light source control map comprising light source control signals of indirect lighting based on finishing material colors and target indirect lighting colors; and correcting a light source color of the control target indirect lighting by the generated light source control signal.

7. The method of claim 6, wherein the input finishing material color is input by selecting one of color groups comprising at least two of a brown group, a blue group, a green group, a red group, a beige group, and a black group.

8. The method of claim 6, wherein, when a predetermined reference finishing material color is different from the input finishing material color input to the input unit, each of the light source control signals controlling the color of indirect lighting reflected from a finishing material having the input finishing material color to be the same as the target indirect lighting color reflected from a finishing material having the reference finishing material color is output by a controller.

9. The method of claim 8, wherein the controller stores color coordinates of correction values of a light source matched according to finishing material colors according to indirect lighting colors realizable in the vehicle.

10. The method of claim 8, wherein the light source control signals comprise red, green, blue (RGB) signals driving RGB light emitting diodes (LEDs) serving as a light source of the control target indirect lighting.

* * * * *